United States Patent [19]

Viola

[11] Patent Number: 4,578,285

[45] Date of Patent: Mar. 25, 1986

[54] INK JET PRINTING SUBSTRATE

[75] Inventor: Michael S. Viola, Burlington, Mass.

[73] Assignee: Polaroid Corporation, Cambridge, Mass.

[21] Appl. No.: 661,119

[22] Filed: Oct. 15, 1984

Related U.S. Application Data

[63] Continuation-in-part of Ser. No. 475,896, Mar. 16, 1983, abandoned.

[51] Int. Cl.[4] ..... B41M 5/00

[52] U.S. Cl. ..... 427/209; 346/1.1; 346/135.1; 400/126; 427/261; 427/421; 428/195; 428/331; 428/480; 428/483

[58] Field of Search ..... 346/135.1, 1.1; 428/207, 211, 331, 423.1, 537.5, 195, 336, 480, 483, 500; 427/146, 152, 209, 210, 256, 261, 288, 421; 400/126

[56] References Cited

U.S. PATENT DOCUMENTS

| | | | |
|---|---|---|---|
| 4,371,582 | 2/1983 | Sugiyama et al. | 428/211 |
| 4,460,637 | 7/1984 | Miyamoto et al. | 428/211 |
| 4,481,244 | 11/1984 | Haruta et al. | 428/211 |
| 4,496,629 | 1/1985 | Haruta et al. | 428/211 |

*Primary Examiner*—Bruce H. Hess

[57] ABSTRACT

A printing substrate adapted to receive ink droplets to form an image generated by an ink jet printer which comprises a transparent support carrying a layer comprising at least 70 weight percent polyurethane and 5 to 30 weight percent of a polymer selected from the group consisting of polyvinylpyrrolidone, polyvinylpyrrolidone/vinyl acetate copolymer, poly(ethyleneoxide), gelatin and polyacrylic acid.

18 Claims, No Drawings

INK JET PRINTING SUBSTRATE

CROSS REFERENCE TO RELATED APPLICATION

This application is a continuation-in-part of copending application Ser. No. 475,896, filed Mar. 16, 1983.

BACKGROUND OF THE INVENTION

Ink jet printing refers to a method of forming type characters on paper by ejecting ink droplets from a print head through one or more nozzles. Several schemes are utilized to control the deposition of the ink droplets to form the desired characters. For example, one method comprises deflecting electrically charged droplets by electrostatic means. Another method comprises the ejection of single droplets under the control of a piezoelectric device.

Since the jets through which the very fine droplets are ejected are prone to clogging, it is advantageous in the art to employ inks of the so-called non-drying type which function by quickly penetrating the paper fibers, thus giving the appearance of being dry to the touch while still possessing a quantity of relatively low vapor pressure solvent. In fact, the time for the solvent to actually evaporate is often in excess of 12 hours.

The requirements for such inks have heretofore precluded the development of a satisfactory transparency printing substrate.

U.S. Pat. No. 4,371,582, issued Feb. 1, 1983, is directed to an ink jet recording sheet containing a basic latex polymer. When ink jet recording is applied on the ink jet recording sheet containing a basic polymer latex with an aqueous ink containing a direct dye or an acid dye having an anionic dissociable group, the dye in the aqueous ink is ionically bonded with the basic polymer latex in the recording sheet.

The basic polymer latex is represented by the formula:

$$(A)_x(B)_y(C)_z$$

wherein (A) represents a polymeric unit formed by copolymerizing a copolymerizable monomer containing a tert-amino group or a quaternary ammonium group; (B) represents a polymeric unit formed by copolymerizing a copolymerizable monomer containing at least two ethylenically unsaturated groups; (C) represents a polymeric unit formed by copolymerizing copolymerizable ethylenically unsaturated monomers other than those used for forming (A) and (B); x represents from 10 to 99 mol %; y represents from 0 to 10 mol %; and z represents from 0 to 90 mol %.

U.S. Pat. No. 3,992,416, issued Nov. 25, 1975 is directed to an optically clear, embossable medium for recording and storage of holographic information which comprises a transparent substrate and an embossable resin wherein the embossable resin may be polyurethane. If desired, to reduce tack, a vinyl copolymer of vinyl chloride and vinyl acetate and/or vinyl alcohol may be admixed with the polyurethane.

U.S. Pat. No. 3,158,494, issued Nov. 24, 1964, is directed to a printing substrate which contains a polyurethane layer. The patent discloses the ink-receptive surface as being solely polyurethane or pigment-containing a polyurethane.

SUMMARY OF THE INVENTION

The present invention is directed to a printing substrate or recording sheet adapted to receive and record an image formed by ink droplets generated by an ink jet printer wherein said substrate comprises a transparent support carrying a layer comprising at least 70% by weight polyurethane and 5–30% by weight of a polymer selected from the group consisting of polyvinylpyrrolidone, polyvinylpyrrolidone/vinyl acetate copolymer, poly(ethylene oxide), gelatin and polyacrylic acid.

DETAILED DESCRIPTION OF THE INVENTION

In the selection of a printing substrate in which the image is formed by the ink jet printer, ink absorbance, in order to prevent lateral flow of the ink drop to avoid loss of resolving power, is one of the principle considerations. Since a so-called non-drying ink is employed to prevent nozzle clogging, absorbance into the substrate is essential to qive the impression of a dry printed image, i.e. one that will not smear to the touch. However, a substance that possesses satisfactory absorbance often produces loss of density and inaccurate color reproducibility in the printer image. These deficiencies in the substrate are even more pronounced when attempting to obtain a transparency image since polymeric materials usually available do not permit sufficiently rapid penetration of the ink. It has also been found that the ambient drying conditions effect the quality of the printed image. Thus, the humidity of the area surrounding the image as it is printed can influence depth and rate of ink penetration into the printing substrate as well as dot spreading.

It has now been found, surprisingly that employing a transparent support carrying a layer comprising at least 70% by weight polyurethane and 5–30% by weight a polymer selected from the group consisting of polyvinylpyrrolidone, polyvinylpyrrolidone/vinyl acetate copolymer, poly(ethylene oxide) copolymer, gelatin and polyacrylic acid, superior results can be obtained in terms of an image from an ink jet printer. The printing substrate of the present invention also permits ink jet printing which is less susceptable to varying conditions of humidity.

The printing substrate of the present invention is employed with inks that contain swelling agents for the polyurethane and comprise solvent for the polyurethane. However, it should be understood that solution of the polyurethane is not the mechanism involved in the image formation.

It has been found that by including the specified water-soluble polymer in the ink receptive layer with the polyurethane, the above-mentioned advantageous results can be achieved. It should be noted that not all water-soluble polymers can be employed with polyurethane to achieve the desired result. Most water-soluble polymers are not compatible with polyurethane, i.e., they produced hazy films and/or cloudy solutions which render thus-formed printing layers unsuitable for use as a transparency. Such materials include, for example hydroxyethyl cellulose and methylvinyl ether/-maleic anhydride copolymer.

The type of polyurethane employed in the present invention is not critical. Aliphatic and aromatic types are suitable although the aliphatic type is preferred particularly since this type produces a non-yellowing film. The terms "aliphatic" and "aromatic", as used herein, are used in the conventional sense in the art and refer to the "hard" segments of the polymer which are provided by aliphatic or aromatic isocyanates or diols. Preferably, the polyurethane employed is what is known in the art as a "water-borne" polyurethane. Such polyurethane compositions are not solely organic solvent solutions but rather are made up of solvent systems that include a predominant amount of water. Thus, a typical water-borne polyurethane would consist of 30% (solids) polyurethane, 15% N-methylpyrrolidone and 55% water. It should be understood, however, that polyurethanes in organic solvents can be employed in the present invention provided the solvent is selected to avoid an incompatibility with the specified water-soluble polymer.

In a preferred embodiment, the printing layer also includes a non-ionic surfactant to improve dot-spreading. Dot-spreading describes the blending of adjacent ink droplets on a substrate. An image in which there is insufficient dot spreading will appear undersaturated and mottled, while too much spreading will cause loss in resolution and definition of the printing characters. The non-ionic surfactant is employed at a level of about 0–5.0% by weight. Amounts of surfactants greater than about 5% adversely affected high humidity performance of the substrate. It should be noted that anionic and cationic surfactants are not suitable because of no effect or a detrimental effect on dot-spreading is observed or because of incompatability with the polymers. Particularly preferred surfactants include modified oxyethylated straight chain alcohols such as PLURAFAC C-17 sold by BASF Wyandotte Corp., Parsippany, NJ.

In still another embodiment, in order to prevent front-to-back blocking of the printing substrates and to improve slippage in the printer, silica at a level ranging from about 0–0.5% by weight may be employed. The size of the silica employed in the present invention is about 4–8 micrometers.

The molecular weight of the polyvinylpyrrolidone employed in the present invention is not critical. Suitable printing subtrates have been made with molecular weight ranging from 40,000 to 360,000.

Poly(ethylene oxide) polymers having molecular weights ranging from 100,000 to 600,000 have been employed satisfactorily. However, poly(ethylene oxide) having a molecular weight of less than 20,000 is not compatible with polyurethane.

Gelatins suitable for use in the present invention include acid pigskin, phthallic anhydride derivatized bone, and TMA derivatized pigskin and bone gelatin.

Polyacrylic acids ranging from 6,000 to 1,000,000 in molecular weight are also useful in the present invention.

In a particularly preferred embodiment, the novel substrate of the present invention comprises a transparent support carrying a layer comprising at least 70% by weight water-borne polyurethane
5–30% by weight of poly(ethyleneoxide)
0.5–5% by weight of anionic surfactant
0–0.5% by weight of silica (4–8 micrometers)

More preferably the novel substrate comprises a transparent polyester support carrying a layer comprising 88% by weight polyurethane (NeoRez R-960, sold by Polyvinyl Chemicals, Wilmington, MA)
9.8% by weight poly(ethylene oxide) M.W=300,000
2% by weight oxyethylated straight clean alcohol (PLURAFAC-C-17)
0.2% by weight 4–8 micrometers amorphous silica The thickness of the printing layer may vary over a relatively wide range. The initial, dry layer before printing may have a thickness ranging from about 0.5 to 50 micrometers, more preferably 5 to 25 micrometers. In a particularly preferred embodiment, the layer is about 15 micrometers. It should be understood that very thick layers would require an anti-curl coat on the opposite side of the support. Anti-curl coats are conventional, particularly in the photographic art and provide a counterbalance to the tendency of a layer on the other side of a support to curl, usually as a result of being wetted and dried during the image-forming process.

As stated above, in a preferred embodiment, the novel printing substrate of the present invention is employed with an ink which contains an organic solvent for polyurethane as a swelling agent. Such inks also generally contain a thickener such as ethylene glycol, which is not a solvent or swelling agent for polyurethane.

As examples of suitable swelling agents for polyurethanes which may be employed in the inks, mention may be made of ethylene glycol methyl ether, ethylene glycol monoethyl ether, ethylene glycol monobutyl ether, diethylene glycol methyl ether, diethylene glycol monoethyl ether, diethylene glycol monobutyl ether, isopropanol, n-butanol, iso-butanol, t-butanol, benzyl alcohol, and N-methyl-2-pyrrolidone. Particularly preferred are those solvents having a Relative Evaporation Rate (butyl acetate=1) of less than about 0.5, and, more preferably diethylene glycol monobutyl ether.

The support employed in the present invention is not critical. Polymeric films of both the synthetic type and those derived from natural occuring materials, may be employed. As stated above, in a preferred embodiment, the support is transparent to provide a transparency. Alternatively, an opaque support is employed to provide a reflection print. As examples of suitable transparent synthetic polymeric materials mention may be made of polymethacrylic acid, methyl and ethyl esters; polyamides, such as nylons; polyesters such as the polymeric films derived from ethylene glycol terephthalic acid; polymeric cellulose derivatives; polycarbonates, polystyrene and the like. To promote adhesion, subcoats or surface treatments such as corona discharge may be employed. If paper or other fibrous material is employed as the support, the polyurethane layer should be sufficiently thick so that the image is formed solely in the polyurethane layer.

The term "image" as used herein, it intended to include the recording of alpha-numeric characters as well as graphic representations.

What is claimed is:

1. A transparent ink jet printing substrate which comprises a transparent support carrying an ink receptive layer consisting essentially of at least 70% by weight of polyurethane and 5 to 30% by weight of a polymer selected from the group consisting of polyvinylpyrrolidone, polyvinylpyrrolidine/vinyl acetate compolymer, poly(ethylene oxide), gelatin and polyacrylic acid.

2. The product of claim 1 which includes an anionic surfactant.

3. The product of claim 1 which includes amorphous silica.

4. The product of claim 1 wherein said support is polyethylene terephthalate.

5. The product of claim 1 wherein said layer is 0.5 to 50 micrometers in thickness.

6. The product of claim 5 wherein said layer is about 5 to 25 micrometers in thickness.

7. The product of claim 1 wherein said support carries an anticurl coat on the side opposite said layer.

8. The product of claim 1 wherein said polyurethane is a water borne polyurethane.

9. The method of ink jet printing which comprises contacting a printing substrate with at least one stream of ink droplets generated from an ink jet printer, where said substrate comprises a transparent support carrying an ink receptive layer consisting essentially of at least 70% by weight of polyurethane and 5 to 30% by weight of a polymer selected from the group consisting of polyvinylpyrrolidone, polyvinylpyrrolidone/vinyl acetate copolymer, poly(ethylene oxide), gelatin and polyacrylic acid.

10. The method of claim 9 which includes an anionic surfactant.

11. The method of claim 9 which includes amorphous silica.

12. The method of claim 9 wherein said support is polyethylene terephthalate.

13. The method of claim 9 wherein said layer is 0.5 to 50 micrometers in thickness.

14. The method of claim 13 wherein said layer is 5 to 25 micrometers in thickness.

15. The method of claim 9 wherein said support carries an anticurl coat on the side opposite said layer.

16. A transparent ink jet printing substrate which comprises a transparent support carrying an ink receptive layer consisting essentially of at least 70% by weight polyurethane
5–30% by weight poly(ethylene oxide)
0.5–5% by weight of anionic surfactant
0–0.5% by weight of silica.

17. The product of claim 16 wherein said support is polyethylene terephthalate.

18. A printing substrate which comprises a transparent support carrying a layer comprising 88% by weight polyurethane
9.8% by weight poly(ethylene oxide)
2% by weight oxyethylated straight chain alcohol
0.2% by weight 4–8 micrometers amorphous silica.

* * * * *